United States Patent [19]

Garner

[11] Patent Number: 4,499,622

[45] Date of Patent: Feb. 19, 1985

[54] GRIPPER ASSEMBLY

[75] Inventor: Derek H. Garner, Leicester, England

[73] Assignee: USM Corporation, Farmington, Conn.

[21] Appl. No.: 462,667

[22] Filed: Jan. 31, 1983

[30] Foreign Application Priority Data

Feb. 6, 1982 [GB] United Kingdom ..... 8203472

[51] Int. Cl.[3] ..... A43D 21/16

[52] U.S. Cl. ..... 12/14.5; 12/8.5

[58] Field of Search ..... 12/8.4, 8.5, 10.1, 10.4, 12/10.7, 12.2, 12.4, 14.3, 14.5

[56] References Cited

U.S. PATENT DOCUMENTS

| | | | |
|---|---|---|---|
| 3,885,263 | 5/1975 | Gagnon | 12/12.3 |
| 4,155,135 | 5/1979 | Becka | 12/14.5 |
| 4,173,050 | 11/1979 | Vornberger | 12/14.5 |
| 4,205,409 | 6/1980 | Walega | 12/14.5 |
| 4,240,172 | 12/1980 | Garner | 12/14.5 |
| 4,266,311 | 5/1981 | Winter | 12/14.5 |

FOREIGN PATENT DOCUMENTS

| | | | |
|---|---|---|---|
| 2114868 | 9/1983 | United Kingdom | 12/8.5 |

*Primary Examiner*—Werner H. Schroeder
*Assistant Examiner*—Steven N. Meyers
*Attorney, Agent, or Firm*—Donald N. Halgren

[57] ABSTRACT

In a pulling over and toe lasting machine the construction of the gripper assemblies (12) and their mountings is simplified firstly to enable the assemblies to be standardized and secondly, by means of a simple manual operation, readily to be located and oriented in relation to the shoe support means (10) in accordance with the shoe style to be operated upon. Furthermore, the most heelwardly disposed gripper assemblies (No. 2 gripper assemblies) are mounted each on a slide-way inclined at about 17° to the longitudinal center line of the machine, and a single mechanism firstly allows their positions along the slide-ways to be simultaneously adjusted and secondly, by means of a fluid pressure operated piston-and-cylinder arrangement, allows them to effect a heelward pull on an upper gripped thereby.

13 Claims, 4 Drawing Figures

16
18
79
79
12
10
12
12
14

GRIPPER ASSEMBLY

BACKGROUND OF THE INVENTION (1) Field of the Invention

This invention is concerned with a gripper assembly for use in a machine for pulling over and lasting toe portions of shoes and with such machines when incorporating such gripper assemblies. The term "shoe" where used herein is used generically as indicating articles of outer footwear generally and including such articles in the course of their manufacture.

(2) Prior Art

Machines for pulling over and lasting toe portions of shoes conventionally comprise shoe support means for supporting, bottom down, a shoe assembly comprising an upper on a last and an insole on the last bottom, a plurality of gripper assemblies arranged in a generally inverted U-formation about the shoe support means, means for effecting relative heightwise movement between the shoe support means and the gripper assemblies whereby the toe end portion of the upper of a shoe supported by the shoe support means and gripped by the gripper assemblies can be tensioned on its last, and wiper means by which lasting marginal portions of the upper, tensioned as aforesaid, are wiped over and pressed against corresponding marginal portions of the insole of the shoe assembly.

In machines of the aforementioned type, it is often the case that various gripper assemblies are differently constructed according to their position in relation to the shoe support means; further the cost of manufacturing the grippers tends to be greater than if the various assemblies were standard one with another. Furthermore, it is frequently the case that, in order to re-set the various gripper assemblies in relation to one another according to the style of shoe to be operated upon, relatively complicated mechanisms are provided and the re-setting operation tends to be time-consuming and tedious. What is more, whereas the individual design of gripper assembly can be dictated to some degree by the general requirements for re-setting, where standard gripper assemblies are provided, the re-setting facilities have also to be standard, and thus accommodate whichever position the gripper assembly is located in.

It is the object of the present invention therefore to provide an improved gripper assembly for use in a shoe toe lasting machine, which gripper assembly is provided with relatively simple setting facilities, but which can nevertheless be used in any of the various localities in relation to the shoe support means of the machine which the gripper assembly is to form part.

BRIEF SUMMARY OF THE INVENTION

The invention therefore provides, in accordance with one of its several aspects, a gripper assembly for use in a machine for pulling over and lasting toe portions of shoes comprising (i) a housing supporting two gripper jaws, (ii) means supported by the housing for effecting relative movement of approach and separation between said jaws, (iii) first support plate means supporting said housing, (iv) second support plate means connected by a pin-and-slot connection to the first support plate means, whereby the position of the latter in relation to the former can be adjusted so as to enable the position of the gripper jaws to be set in relation to shoe support means of a machine of which the assembly forms part, both towards and away from such support means and also along an arcuate path generally lengthwise of said means, (v) first clamp means for clamping the first support plate means in adjusted position on the second support plate means, said clamp means being manually operable, (vi) a support shaft on which the second support plate means is supported for adjusting movement about the axis of said shaft, whereby also to enable the position of the gripper jaws to be set, generally lengthwise of said shoe support means, in relation to said means, and (vii) second clamp means for clamping the second support plate means in adjusted position in relation to the support shaft.

It will thus be appreciated that, by means of the pin-and-slot connection between the first and second support plate means, each gripper assembly can be readily located in a desired relationship with the shoe support means, the mounting of the second support plate means on the support shaft merely serving to provide added lengthwise adjustment of the gripper assembly position where a significant degree of re-setting in said direction is required. Furthermore, since the first clamp means is manually operable, that is to say can be released and re-applied by hand, a re-setting of the gripper assembly can be speedily achieved. Conveniently, furthermore, the second clamp means is also manually operable.

Each of the first and second support plate means may comprise a single plate member, but preferably the first support plate means comprises an upper and a lower plate, the upper plate supporting said housing and being mounted on the lower plate for limited sliding movement thereon in a direction towards and away from said shoe support means, and the lower plate being mounted on the second support plate means for pivotal movement thereon, when said first clamp means is released. Furthermore, preferably the lower plate has a depending flange portion having a lip which engages over a corresponding surface portion of the second support plate means whereby to maintain the first and second support plate means in surface contact.

By the above arrangement, using a single means the in-out and lengthwise adjustment of the gripper assembly can take place while requiring only a single clamp means, but the relative movement between the various integers and the second support plate means is such that the first and second support plate means can be maintained in surface contact. This feature is especially important, furthermore, where the support shaft is disposed at or adjacent one end of the first and second support plate means, at which end the housing for the gripper jaws is also disposed, since any tendency, because of the stress applied to the gripper assembly when an upper is tensioned thereby, for the support shaft to be distorted because of the relationship between the grippers, the pin-and-slot connection and support shaft is mitigated by the action of the lip of the depending flange portion of the lower plate.

Conveniently, the upper plate has a slot extending in a direction towards the shoe support means for receiving a shank portion of a clamp bolt (on which is carried a clamp nut of the first clamping means) carried by the second support plate means, while the lower plate has two or more apertures through any one of which said bolt can pass, the apertures being aligned with the slot in the upper plate, and the bolt thus serving to limit the sliding movement of the upper plate in relation to the lower. Thus, in using the machine, the bolt can be accommodated in a selected one of said apertures, which thus serves to provide a coarse setting for the in-out position of its associated gripper assembly, a finer setting then being achieved by means of the slot in the upper plate. In this way, the machine can be set up generally for e.g. men's, ladies' or children's work.

The machine in accordance with the invention is generally as set out in the second paragraph above and conveniently comprises at least five gripper assemblies in accordance with said invention arranged about the shoe support means. In the case of the assemblies other than those disposed, one at either side of the shoe support means, most heelwardly, the second support plate means may be mounted on a support shaft for pivotal adjusting movement with the shaft about its axis. In the case of the most heelwardly disposed assemblies, on the other hand, preferably the support shaft has fixedly secured thereto a slide member on which the second support plate means is mounted for sliding movement in a direction which, when the assembly forms part of a machine, is inclined at an acute angle to the longitudinal center line of the shoe support means of such machine, thus to adjust the position of the gripper jaws of said assembly generally lengthwise of said shoe support means.

In either case, the position of the gripper jaws and their housing can thus be adjusted, lengthwise with the shoe support means, in a coarse setting by their mounting on the support shaft, a finer setting being achieved using the pin-and-slot connection. In addition, by the mounting as aforesaid of the two most heelwardly disposed gripper assemblies, a more significant lengthwise adjustment can be achieved, which is generally considered desirable in respect of such grippers in toe lasting machines.

Furthermore, conveniently the second support plate means of each of the two most heelwardly disposed gripper assemblies is connected to an adjustment member, the two adjustment members being each pivotally mounted on a frame portion of the machine and being interconnected by a linkage arrangement such that pivotal movement of the one member causes corresponding pivotal movement, in a contrary direction, of the other, and in addition one of said members has associated therewith means for varying the position thereof and for maintaining it in adjusted position. In addition, more specifically, one adjustment member may be connected to its associated second support plate means via a further adjustment member adjustment of the position of which is thus effective to vary the relationship between the two adjustment members and thus the relative lengthwise positions of the housings.

It will thus be appreciated that firstly by means of the further adjustment member the positions of each of the two most heelwardly gripper assemblies can be set relative to one another, while, in order, e.g. to accommodate changes between men's and children's sizes, a further relatively coarse adjustment can be made by means of the first-mentioned adjustment member. It will further be appreciated that by both the pin-and-slot connection and, in the case of the assemblies other than the two most rearwardly disposed, by the pivotal mounting on the support shaft, orientation of each gripper assembly along an arcuate path can also be achieved.

The mechanism by which the position of the two most heelwardly disposed gripper assemblies can be adjusted as described above may also be utilized for effecting a rearward pull by said assemblies on an upper, lasting marginal portions of which are gripped thereby, such rearward pull taking place, in the operation of the machine, simultaneously with relative heightwise movement taking place between the shoe support means and the gripper assemblies as a whole. To this end, conveniently fluid pressure operated means is operatively connected to one of said adjustment members and is effective to cause pivotal movement of said member, and thus, through the linkage arrangement, of the other of said members to take place. In a preferred embodiment, the adjustment member to which the fluid pressure operated means is connected is also the member with which the means for varying the position of the members is associated, said last-mentioned means comprising a further member connected to the fluid pressure operated means and mounted for pivotal movement about the axis of pivot of said one adjustment member, said further member and said one adjustment member being provided one with a series of apertures and the other with a pin, and said last-mentioned means comprising a handle incorporating a pin-withdrawal arrangement, whereby, for adjusting the position of the two most heelwardly disposed gripper assemblies, the operator causes the pin to be withdrawn and said one adjustment member to be moved about its pivot to bring the pin and a selected aperture into alignment, the pin then being located in said selected aperture.

It will thus be appreciated that, with regard to the two most heelward gripper assemblies, a relatively simple arrangement is provided for effecting both a speedy adjustment of the positions of said assemblies, and also for providing a rearward pull in the operation of the machine.

BRIEF DESCRIPTION OF THE DRAWINGS

There now follows a detailed description, to be read with reference to the accompanying drawings, of three gripper assemblies in accordance with the invention and a pulling over and toe lasting machine in accordance with the invention, these assemblies and this machine having been selected for this description merely by way of exemplification of the invention and not by way of limitation thereof.

In the accompanying drawings.

DESCRIPTION OF THE PREFERRED EMBODIMENT

Figure 1:
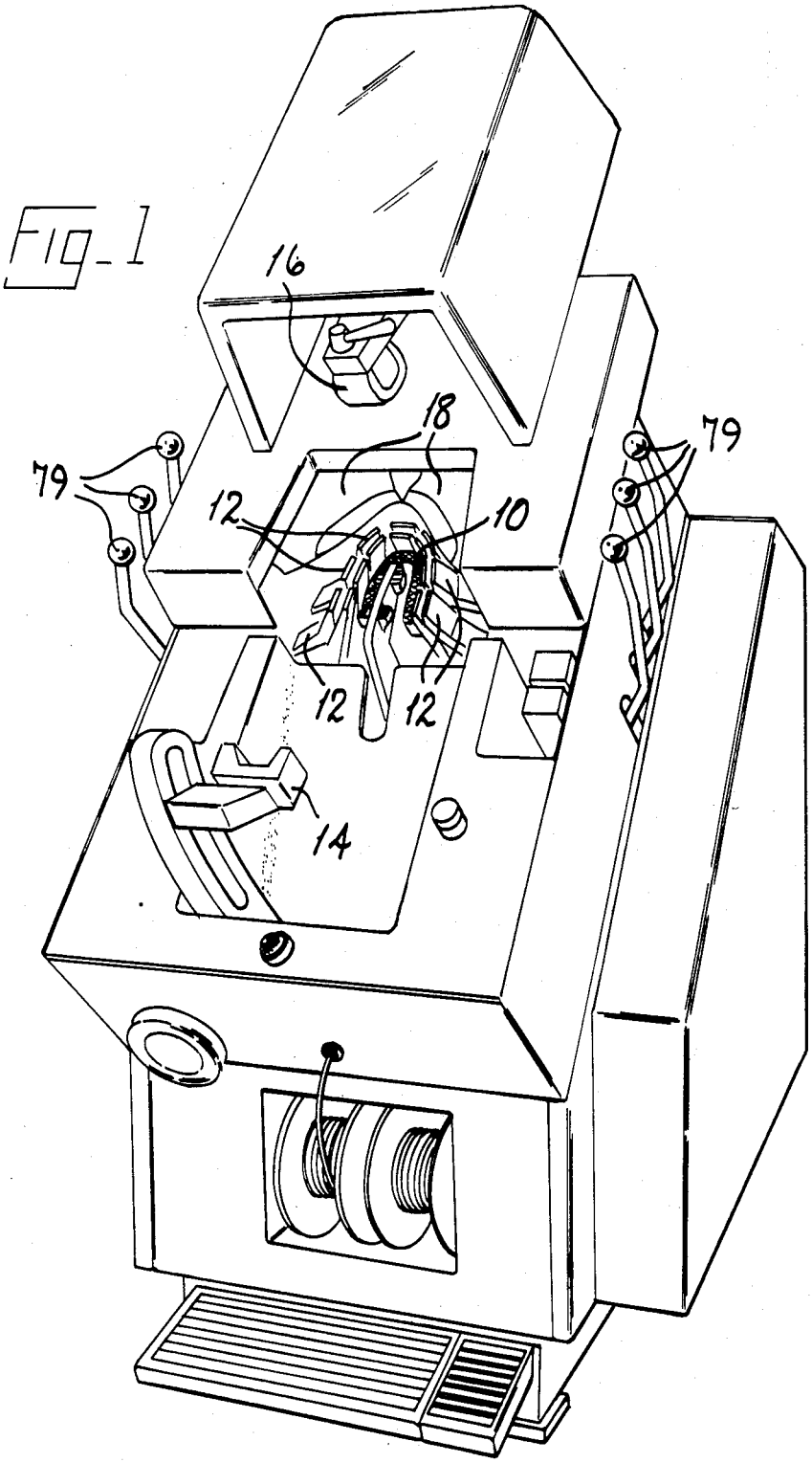
FIG. 1 is a perspective view of a machine in accordance with the invention, showing a plurality of gripper assemblies thereof and associated parts.

The machine in accordance with the invention comprises a shoe support means 10 as shown in FIG. 1, including a generally U-shaped insole plate by which hot melt adhesive can be applied to the insole of a shoe supported thereby prior to the operation of the machine, as is conventional, and arranged about said plate, in a generally inverted U-shaped configuration, is a plurality of (in this case seven) gripper assemblies 12 by which lasting marginal portions of the upper of a shoe supported by the shoe support means 10 can be gripped, whereafter, upon relative heightwise movement being effective between said gripper assemblies 12 and said shoe support means 10, such upper can be tensioned about its last, also in a conventional manner. The machine also comprises, as is conventional, a heel rest 14, a toe pad 16 and wiper plates 18, by means of which latter the marginal portions of the upper, after being tensioned as aforesaid, can be wiped over and pressed against corresponding marginal portions of the insole, the adhesive previously being applied so that said marginal portions are bonded together.

Figure 2:
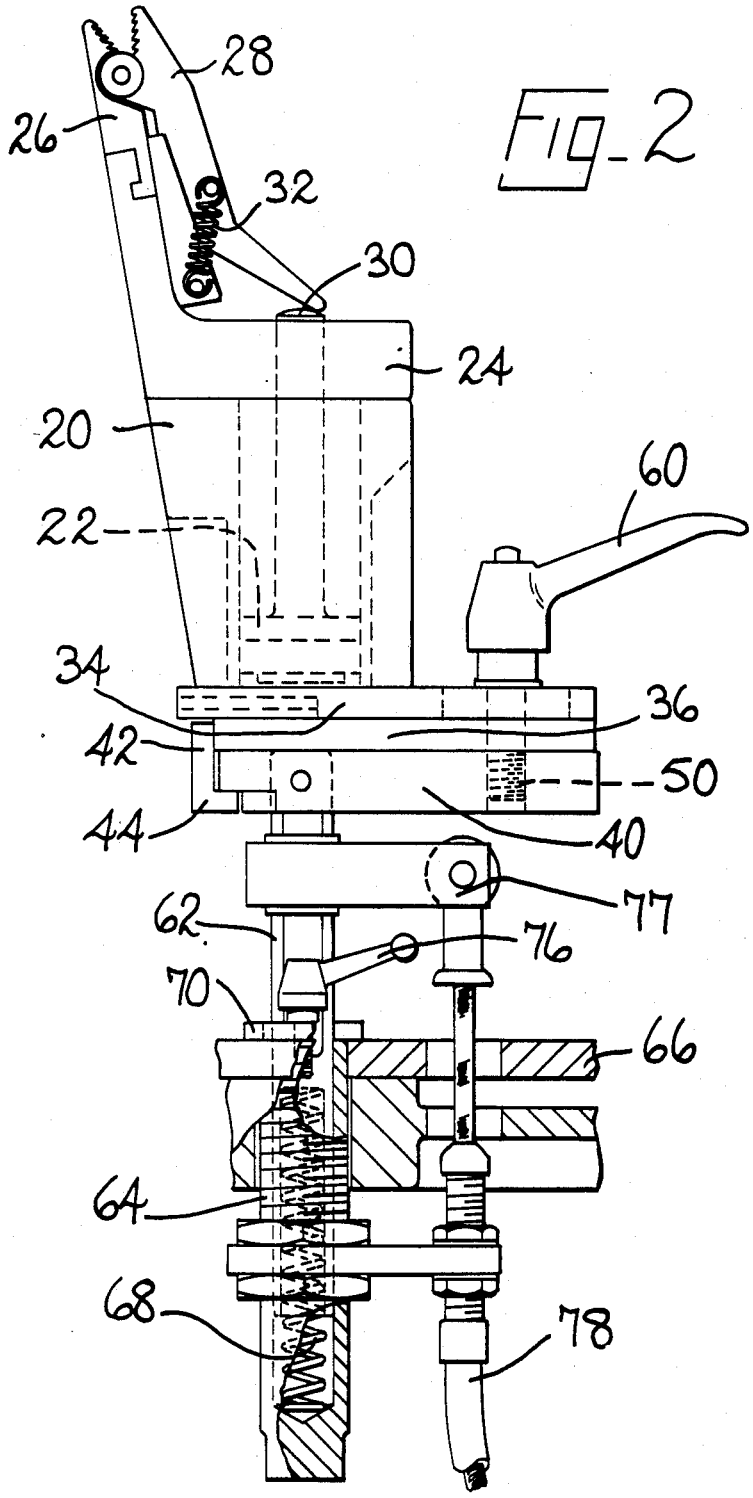
FIG. 2 is a fragmentary view, partly in section, showing details of one gripper assembly in accordance with the invention.

A first gripper assembly in accordance with the invention comprises a housing 20 as shown in FIG. 2 which constitutes a cylinder in which a piston 22 is slidingly accommodated. A cover plate 24 for the cylinder has a first, fixed, jaw 26 formed integral therewith, and pivoted on said jaw 26 is a movable jaw 28, a depending tail portion of which is arranged to be engaged by an end portion of a piston rod 30 carried by the piston 22. A spring 32 acts between the fixed and movable jaws 26, 28 urging the tail portion into engagement with the piston rod, and thus urging the gripper jaws to an open condition. Admission of fluid under pressure to the cylinder counters the action of the spring to close the jaw members.

Figure 3:
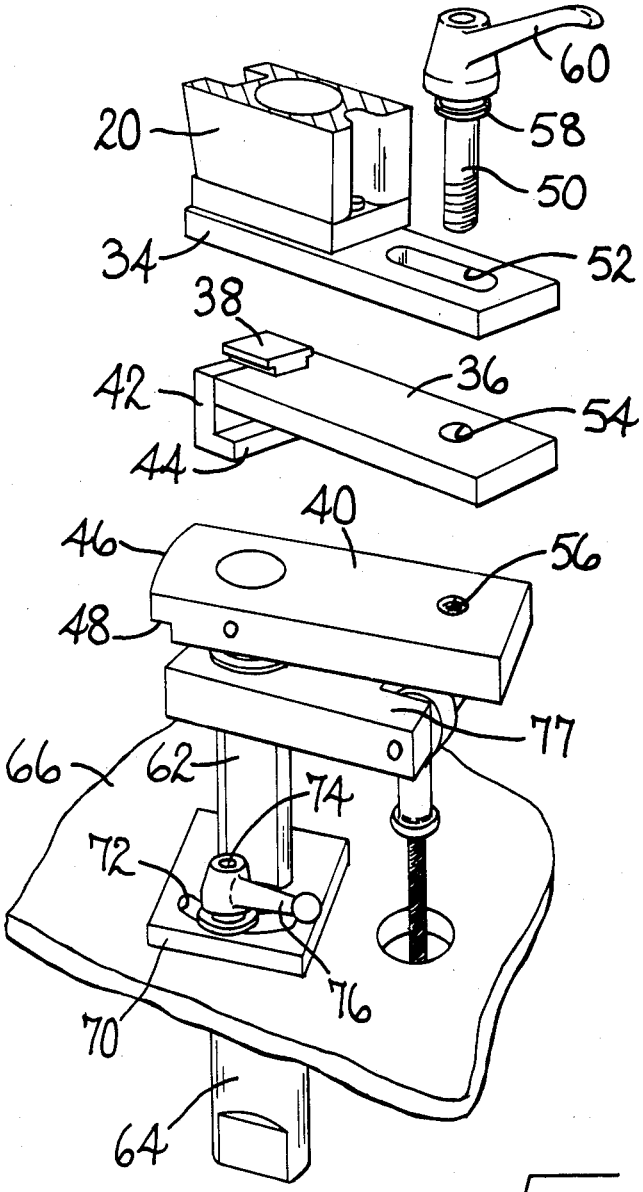
FIG. 3 is an exploded view of one such gripper assembly.

The housing 20 is secured to first support plate means of the gripper assembly, said means comprising an upper plate 34 (FIG. 3) which is mounted for sliding movement on a lower plate 36 of said means, the lower plate having a T-shaped projection 38 which engages in a complementarily shaped slot in the upper plate so as to guide the upper along a rectilinear path in relation to the lower plate.

The lower plate 36 is supported by second support plate means of the assembly in accordance with the invention, said second means comprising a block 40. The lower plate 36 has formed, at one end, a depending flange 42 with an inturned lip 44, and the support block 40, at a corresponding end thereof, has an arcuate end face 46 and cut-away portion 48 therebeneath, the arrangement being such that, when the assembly is assembled, the cover plate 36 can pivot relative to the block 40, without risk of jamming, but is nevertheless held in surface contact with the block by the interaction of the lip 44 with the cut-away portion 48.

The first and second support plate means are secured together by a bolt 50 which passes through a slot 52 in the upper plate 34 and an aperture 54 in the lower plate 36 and is threadedly received in a threaded bore 56 in the block 40. The bolt 50 has a shoulder 58 by which the upper surface of the upper plate 34 is engaged, thus to clamp the plates 34, 36 and the block 40 together in adjusted position, a handle 60 being provided on the bolt 50 for easy manual use. The slot 52 serves to allow lengthwise sliding movement of the upper plate 34 relative to the lower plate 36, while the aperture 54 enables the first support plate means to be pivoted bodily about the axis of the bolt 50 in relation to the block 40.

In this way, the jaw members 26, 28 can be moved in and out towards and away from the shoe support means 10, and also are effectively movable lengthwise in relation to said support means, while at the same time facilitating arcuate orientation of the jaw members in relation to said support means.

The support block 40 is carried by a support shaft 62 which projects upwardly from and is mounted in a housing 64 secured in a base plate 66 on which all of the gripper assemblies are mounted, and which forms part of the machine frame. A spring 68 is also accommodated in the housing 64 and acts to urge the support rod 62 and thus the housing 20 upwardly. The support rod 62, which is provided with two flatted portions, also passes through a plate 70 having a slot 72 formed therein through which a clamp bolt 74 passes, the bolt being screwed into the base plate 66. The slot, which has its center of curvature coincident with the axis of the shaft 62, enables relative movement to take place between the plate 70 and the base plate about said axis, where by the orientation of the support block 40, and thus of the housing 20 and the gripper jaws 26, 28 can be adjusted. A manually operable handle 76 facilitates the quick release and reclamping of the plate 70 in adjusted position. The adjustment about the axis of the shaft 62 is to be regarded as a coarse setting for the gripper assembly, a finer setting then being provided by release of the clamp bolt 50, as described above. The clamp bolts 50, 74 and associated parts constitutes respectively first and second clamp means of the gripper assembly.

It will be seen (from FIG. 2) that the axis of the shaft 62 is substantially beneath the piston rod 30, though slightly offset from the jaws 26, 28. The plates 34, 36, on the other hand, are clamped together at a position spaced from said axis. The lip 44 and cut-away portion 48 thus serve to prevent any distortion forces being applied to the bolt 50 arising from the resistance of the gripper jaws (holding the shoe upper) to a downward draft on the assembly for upper-tensioning purposes.

A second gripper assembly in accordance with the invention (not shown) is generally similar to the first gripper assembly described above, differing only in that the first support place means comprises a single support block replacing the upper and lower plates 34, 36. Furthermore, this replacement block has no lip portion, and thus said one end surface of the support block 40 is square-cut and is not cut away.

For urging the gripper assemblies downwardly in relation to the shoe support means 10 whereby to tension an upper gripped by the gripper assemblies as aforesaid, a bar 77, secured by circlips on the shaft 62 (thereby enabling the shaft to be rotated relative to the bar) has one end of a Bowden cable 78 connected thereto, by which a down-drafting force can be applied to its associated gripper jaws, in a manner described in detail in our copending United Kingdom patent application No. 8014728. For effecting a so-called "discretionary pull" by each gripper assembly 12, furthermore, by which the operator can adjust the position of the tensioned upper on its last, as described in said Application, handles 79 (FIG. 1) are provided, one associated with each gripper assembly.

In the machine in accordance with the invention, each gripper assembly, other than the two most heelwardly disposed gripper assemblies, arranged one at either side of the shoe support means 10, can be constituted either by a first gripper assembly or a second gripper assembly as referred to above, while the two most heelwardly disposed assemblies 12 (FIG. 4) are constituted by third gripper assemblies in accordance with the invention. In the case of each of these gripper assemblies, the upper plate 34 of the first support plate means is connected, by means of the clamp bolt 50 and slot 52, to a support plate 40', constituting the second support plate means. The first support plate means is thus able to pivot about the axis of the bolt 50 and also to slide in-and-out towards and away from the shoe support means 10, when the first clamp means thereof is released. The support plate 40' is provided on its underside with a slideway 80 by which the plate is mounted on a block 82 fixedly carried at the upper end of the support shaft 62. The shaft 62 is carried in the housing 64 and urged upwardly by means of a spring 68, as in the case of the first and second gripper assemblies in accordance with the invention, and further is flatted to maintain it in its orientation in the housing. In this case, however, there is no facility for varying such orientation.

Figure 4:
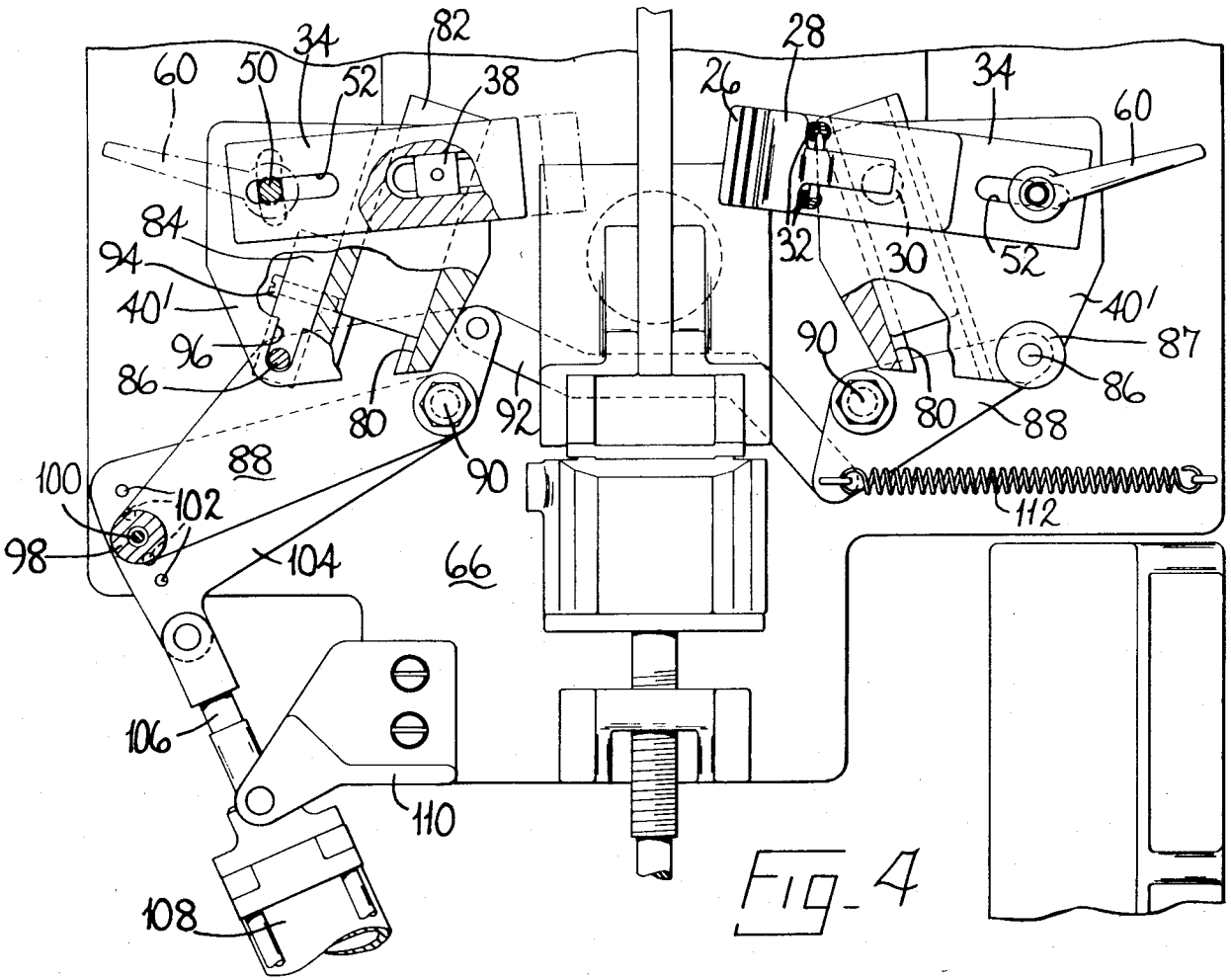
FIG. 4 is a plan view, partly in section showing details of the two most heelwardly disposed gripper assemblies and parts associated therewith.

The longitudinal center line of each block 82, and thus the slide path of each support plate 40', is inclined at an angle of about 17° to the longitudinal center line of the machine. For effecting adjustment movement of each support plate 40', and thus of each of the two most heelwardly disposed gripper assemblies, along the slide path, the support plate 40' of the left hand gripper assembly as shown in FIG. 4 has a block 84 secured to the under-side thereof, said block being connected by a pin 86 to an adjustment plate 88 which is mounted on a pivot pin 90 secured in the base plate 66. The right hand gripper assembly also has associated therewith an adjustment plate 88 pivotal about a pivot pin 90, the plate 88 being connected by means of a pin 86 accomodated in an oversize hole in the support plate 40'. Each pin has a knurled retaining nut 87. The adjustment plates 88 are interconnected by a linkage 92 such that clock-wise movement of the left hand plate about its pivot 90 causes simultaneous counter-clockwise movement of the right hand plate and vice versa. In this way, the housings 20 of the two most heelwardly disposed gripper assemblies 12 are caused to move simultaneously along their slide paths.

For adjusting the two gripper assemblies relative to one another, the block 84 of the left hand assembly is secured to the underside of the support plate 40' by means of a pin 94 screwed into the support plate 40' and accommodated in a slot in the block 84, release of the pin enabling the support plate 40' to move along its slideway relative to the block 84. The upper end of the pin 86 projects beyond the block 84 and a slot 96 is provided therefor in the support plate.

For effecting movement of said gripper assemblies along their slide paths, the left hand adjustment plate 88 carry a handle 98 associated with which is a depending pin 100, which can be received in a selected one of a row of co-operating apertures 102 formed in a lever 104 also pivotal about the pivot pin 90 of the left hand assembly. The handle 100 can be slid by hand heightwise of the adjustment plate 88 in order to release the pin 100 from a selected aperture 102, whereafter the adjustment plate can be pivoted using said handle to bring the pin into alignment with another selected aperture. Instead of such an arrangement, an infinitely variable adjustment, e.g. by a conventional clamp together with a pin-and-slot connection, could be used.

Pivotally connected to a lug of the lever 104 is piston rod 106 of a piston-and-cylinder arrangement 108 carried by a bracket 110 secured to the base plate 66. When the machine in accordance with the invention is in its rest condition, fluid (e.g. air) under pressure urges the piston rod 106 to its extended condition, and thus the two most heelwardly disposed gripper assemblies are urged toewardly. Supplementing the arrangement 108 in this regard, furthermore, is a spring 112 acting between the adjustment plate of the right hand assembly and the base plate 66.

In the operation of the machine, admission of fluid under pressure to the opposite end of the arrangement 108 is effective to cause said gripper assemblies to move heelwardly, thereby applying a heelwardly directed pull to the upper gripped thereby. For limiting such heelward movement, either the stroke of the arrangement 108 may be fixed or the pressure of fluid may be set to a given value (in which latter case the amount of movement will be determined by the stretchability of the upper material).

It will thus be apparent that, in using the machine in accordance with the invention, the two most heelwardly disposed gripper assemblies can be positioned along a path inclined at about 17° to the longitudinal center line of the machine, and can thereafter be drawn heelwardly along said direction, the two assemblies operating simultaneously with one another and a single adjustment arrangement and a single power source being required for effecting both adjustment of their position and the application thereby of a heelward pull.

I claim:

1. A gripper assembly for use in a machine for pulling over and lasting toe portions of shoes comprising:

(i) a housing supporting two gripper jaws, (ii) means supported by the housing for effecting relative movement of approach and separation between said jaws, (iii) first support plate means supporting said housing, (iv) second support plate means connected by a pin-and-slot connection to the first support plate means, whereby the position of the latter in relation to the former can be adjusted so as to enable the position of the gripper jaws to be set in relation to shoe support means of a machine of which the assembly forms part, both towards and away from such support means and also along an arcuate path generally lengthwise of said means, (v) first clamp means for clamping the first support plate means in adjusted position on the second support plate means, said clamp means being manually operable.

(vi) a support shaft on which the second support plate means is supported for adjusting movement about the axis of said shaft whereby also to enable the position of the gripper jaws to be set, generally lengthwise of said shoe support means, in relation to said means, and (vii) second clamp means for clamping the second support plate means in adjusted position in relation to the support shaft.

2. A gripper assembly according to claim 1 wherein the first support plate means comprises an upper and a lower plate, the upper plate supporting said housing and being mounted on the lower plate for limited sliding movement thereon in a direction towards and away from said shoe support means, and the lower plate being mounted on the second support plate means for pivotal movement thereon, when said first clamp means is released.

3. A gripper assembly according to claim 2 wherein the lower plate has a depending flange portion having a lip which engages over a corresponding surface portion of the second support plate means whereby to maintain the first and second support plate means in surface contact.

4. A gripper assembly according to claim 3 wherein the support shaft is disposed at or adjacent one end of the first and second support plate means, at which end the housing for the gripper jaws is also disposed.

5. A gripper assembly according to any one of claims 2 to 4 wherein the upper plate has a slot extending in a direction towards the shoe support means for receiving a shank portion of a clamp bolt (on which is carried a clamp nut of the first clamping means) carried by the second support plate means, and further wherein the lower plate has two or more apertures through any one of which said bolt can pass, the apertures being aligned with the slot in the upper plate, and the bolt thus serving to limit the sliding movement of the upper plate in relation to the lower.

6. A gripper assembly according to claim 5 wherein the second support plate means is mounted on the support shaft for pivotal adjusting movement about the axis of said shaft.

7. A gripper assembly according to claim 1 wherein the support shaft has fixedly secured thereto a slide member on which the second support plate means is mounted for sliding movement in a direction which, when the assembly forms part of a machine, is inclined at an acute angle to the longitudinal center line of the shoe support means of such machine, thus to adjust the position of the gripper jaws of said assembly generally lengthwise of said shoe support means.

8. A machine for pulling over and lasting toe portions of shoes comprising shoe support means for supporting, bottom down, a shoe assembly comprising an upper on a last and an insole on the last bottom, a plurality of gripper assemblies arranged in a generally inverted U-formation about the shoe support means, for effecting relative heightwise movement between the shoe support means and the gripper assemblies whereby the toe end portion of the upper of a shoe supported by the shoe support means and gripped by the gripper assemblies can be tensioned on its last, and wiper means by which lasting marginal portions of the upper, tensioned as aforesaid, are wiped over and pressed against corresponding marginal portions of the insole of the shoe assembly, wherein at least three gripper assemblies according to claim 6 are provided and two gripper assemblies wherein the support shaft has fixedly secured thereto a slide member on which the second support plate means is mounted for sliding movement in a direction which, when the assembly forms part of a machine, is inclined at an acute angle to the longitudinal center line of the shoe support means of such machine, thus to adjust the position of the gripper jaws of said assembly generally lengthwise of said shoe support means, the latter two assemblies being arranged one each side of the shoe support means and constituting the most heelwardly disposed of said plurality of gripper assemblies.

9. A machine according to claim 8 wherein the second support plate means of each of the two most heelwardly disposed gripper assemblies is connected to an adjustment member, the two adjustment members being each pivotally mounted on a frame portion of the machine and being interconnected by a linkage arrangement such that pivotal movement of the one member causes corresponding pivotal movement, in a contrary direction, of the other, and wherein one of said members has associated therewith means for varying the position thereof and for maintaining it in adjusted position.

10. A machine according to claim 9 wherein each adjustment member is connected to its associated second support plate means via a further adjustment member adjustment of the position of which is effective to vary the relationship between the two adjustment members and thus the relative lengthwise position of the housing.

11. A machine according to claim 10 wherein fluid pressure operated means is operatively connected to one of said adjustment members and is effective to cause pivotal movement of said member, and thus, through the linkage arrangement, of the other of said members, to take place whereby, in the operation of the machine, after the gripper assemblies have gripped marginal portions of the upper, said two most heelwardly disposed asssemblies are caused to move along their slides, thus to tension the upper heelwardly as well as heightwise of the last.

12. A machine according to claim 11 wherein the adjustment member to which the fluid pressure operated means is connected is also the member with which the means for varying the position of the members is associated, said last-mentioned means comprising a further member connected to the fluid pressure operated means and mounted for pivotal movement about the axis of pivot of said one adjustment member, said further member and said one adjustment member being provided one with a series of apertures and the other with a pin, and said last-mentioned means comprising a handle incorporating a pin-withdrawal arrangement, whereby, for adjusting the position of the two most heelwardly disposed gripper assemblies, the operator causes the pin to be withdrawn and swings said one ajustment member about its pivot to bring the pin and a selected aperture into alignment, the pin then being located in said selected aperture.

13. A machine for pulling over and lasting toe positions of shoes comprising:

shoe support means for supporting, bottom down, a shoe assembly comprising an upper on a last and an insole on the last bottom;

a plurality of gripper asssemblies arranged in a generally inverted U-formation about the shoe support means, for effecting relative heightwise movement between the shoe support means and the gripper assemblies whereby the toe end portion of the upper of a shoe supported by the shoe support means and gripped by the gripper assemblies can be tensioned on its last; and wiper means by which lasting maginal portions of the upper, tensioned as aforesaid, are wiped over the pressed against corresponding marginal portions of the insole of the shoe assembly, wherein the two most heelwardly disposed gripper assemblies, arranged one at either side of the shoe support means, are connected each to an adjustment member, the two adjustment members being each pivotally mounted on a frame portion of the machine and being interconnected by a linkage arrangement such that pivotal movement of the one member causes corresponding pivotal movement, in a contrary direction, of the other, and wherein one of said members has associated therewith means for varying the position thereof and for maintaining it in adjusted position, and wherein fluid pressure operated means is operatively connected to one of said adjustment members and is effective to cause pivotal movement of said member, and thus, through the linkage arrangement, of the other of said members, to take place whereby, in the operation of the machine, after the gripper assemblies have gripped marginal portions of the upper, said two most heelwardly disposed assemblies are caused to move along their slides, thus to tension the upper heelwardly as well as heightwise of the last.

* * * * *